US010023943B2

(12) United States Patent
Saikawa et al.

(10) Patent No.: US 10,023,943 B2
(45) Date of Patent: Jul. 17, 2018

(54) CASTING ALUMINUM ALLOY AND CASTING PRODUCED USING THE SAME

(71) Applicants: National University Corporation University of Toyama, Toyama (JP); Ahresty Corporation, Aichi (JP)

(72) Inventors: Seiji Saikawa, Toyama (JP); Gen Okazawa, Nagano (JP); Hiroshige Niwa, Nagoya (JP); Kiyoshi Terayama, Imizu (JP); Susumu Ikeno, Toyama (JP); Emi Yanagihara, Toyohashi (JP); Shin Orii, Toyohashi (JP); Suguru Takeda, Toyohashi (JP)

(73) Assignees: National University Corporation University of Toyama (JP); Ahresty Corporation (JP)

( * ) Notice: Subject to any disclaimer, the term of this patent is extended or adjusted under 35 U.S.C. 154(b) by 33 days.

(21) Appl. No.: 15/092,934

(22) Filed: Apr. 7, 2016

(65) Prior Publication Data

US 2016/0222493 A1 Aug. 4, 2016

Related U.S. Application Data

(63) Continuation of application No. PCT/JP2013/077369, filed on Oct. 8, 2013.

(51) Int. Cl.
*C22C 21/08* (2006.01)
*C22C 21/02* (2006.01)
(Continued)

(52) U.S. Cl.
CPC ..... *C22C 21/08* (2013.01); *B22D 21/007* (2013.01); *C22C 21/02* (2013.01); *C22C 21/04* (2013.01)

(58) Field of Classification Search
CPC ..... C21C 21/00; C21C 21/02; C21C 21/04; C21C 21/08; B22D 21/00; C22C 21/00; C22C 21/02; C22C 21/04; C22C 21/08
See application file for complete search history.

(56) References Cited

U.S. PATENT DOCUMENTS 5,223,050 A * 6/1993 Bryant ..... C22F 1/05 148/415
5,961,752 A * 10/1999 Bergsma ..... C22C 21/08 148/550
(Continued)

FOREIGN PATENT DOCUMENTS

CN 101445879 A 6/2009
JP 2002-206133 A 7/2002
(Continued)

OTHER PUBLICATIONS

International Search Report for International Application No. PCT/JP2013/077369 dated Dec. 17, 2013 (2 pages).
(Continued)

*Primary Examiner* — Jennifer A Smith
*Assistant Examiner* — Alexandra M Moore
(74) *Attorney, Agent, or Firm* — Harness, Dickey & Pierce, P.L.C.

(57) ABSTRACT

An Al—Mg—Si-based aluminum alloy includes 0.015 to 0.12 mass % of Sr, the aluminum alloy producing a cast metal structure in which $Mg_2Si$ is crystallized in a fine agglomerate form.

9 Claims, 6 Drawing Sheets

(51) Int. Cl.
*C22C 21/04* (2006.01)
*B22D 21/00* (2006.01)

(56) References Cited

U.S. PATENT DOCUMENTS

2002/0088512 A1 7/2002 Kitaoka et al.
2003/0143102 A1* 7/2003 Matsuoka ..... C22C 21/04 420/546
2006/0169371 A1* 8/2006 Cosse ..... C22C 21/08 148/439
2008/0299001 A1 12/2008 Langlais et al.

FOREIGN PATENT DOCUMENTS

JP 2009-108409 A 5/2009
JP 2010-528187 A 8/2010
WO WO-2008-144935 A1 12/2008
WO WO 2009131267 A1 * 10/2009 ..... C23C 2/12

OTHER PUBLICATIONS

Seiji Saikawa et al., "Effect of Addition of Ti-B and Sr on Hot Tearing of Al—Mg—Si-Based Alloy", Japan Institute of Light Metals Koen Gaiyo, vol. 124, pp. 31-32, Apr. 18, 2013, with English translation.
Gen Okazawa et al., "Effect of Addition of Ti-B and Sr on Hot Tearing of Al—Mg—Si-Based Alloy", Japan Institute of Metals and Materials, Collected Abstracts of 2013, Autumn Meeting of the Japan Institute of Metals and Materials, Sep. 3, 2013, p. 263, with English translation.
Qin et al., "Strontium modification and formation of cubic primary $Mg_2$ Si crystals in $Mg_2$ Si/Al composite" Journal of Alloys and Compounds, vol. 454, pp. 142-146 (2008).

* cited by examiner

FIG. 1

| No | | CHEMICAL COMPONENTS (%) | | | | | | | | EVALUATION |
|---|---|---|---|---|---|---|---|---|---|---|
| | | Mg | Si | Fe | Mn | Sr | Ti | B | BALANCE | CASTING CRACK AREA RATIO (%) |
| EXAMPLE | 1 | 6 | 3 | ≤0.20 | – | 0. 018 | – | – | Al | 45 |
| | 2 | 6 | 3 | ≤0.20 | – | 0. 03 | – | – | Al | 0 |
| | 3 | 6 | 3 | ≤0.20 | – | 0. 04 | – | – | Al | 0 |
| | 4 | 6 | 3 | ≤0.20 | – | 0. 06 | – | – | Al | 0 |
| | 5 | 6 | 3 | ≤0.20 | – | 0. 12 | – | – | Al | 28 |
| | 6 | 6 | 3 | ≤0.20 | 0. 6 | 0. 04 | – | – | Al | 0 |
| | 7 | 6 | 3 | ≤0.20 | – | 0. 04 | 0. 12 | 0. 024 | Al | 0 |
| COMPARATIVE EXAMPLE | 11 | 6 | – | ≤0.20 | – | – | 0. 12 | 0. 024 | Al | 80 |
| | 12 | 2 | 3 | ≤0.20 | – | – | 0. 12 | 0. 024 | Al | 50 |
| | 13 | 6 | 3 | ≤0.20 | – | – | 0. 12 | 0. 024 | Al | 30 |
| | 14 | 6 | 3 | ≤0.20 | – | 0. 009 | – | – | Al | 70 |
| | 15 | 6 | 3 | ≤0.20 | – | – | – | – | Al | 80 |

Al-6%Mg-3%Si
(Sr WAS NOT ADDED)

Al-6%Mg-3%Si
(Sr WAS ADDED)

CASTING ALUMINUM ALLOY AND CASTING PRODUCED USING THE SAME

CROSS REFERENCE TO RELATED APPLICATION

This application is a continuation of International Patent Application No. PCT/JP2013/077369, having an international filing date of Oct. 8, 2013 which designated the United States, the entirety of which is incorporated herein by reference.

TECHNICAL FIELD

The present invention relates to an Al—Mg—Si-based aluminum alloy that is suitable for casting, and a casting produced (cast) using the same. Note that the term "casting aluminum alloy" used herein refers to an aluminum alloy that is used for a casting process (i.e., an aluminum alloy that has not been subjected to a casting process).

BACKGROUND ART

An aluminum alloy is used in a wide variety of fields as a lightweight material, and various aluminum alloys that are suitable for casting have been developed.

A gravity die casting process, a low pressure die casting process, a high pressure casting process, and the like are known as a casting process. A die casting process is classified as a high pressure casting process, and achieves high productivity.

The die casting process injects aluminum alloy molten metal into a die (mold) at a high speed under high pressure to produce a cast member. A JIS (Japanese Industrial Standards) ADC12 aluminum alloy is widely applied to automotive parts and the like since a dense and high-strength cast structure can be obtained.

The ADC12 aluminum alloy is an Al—Si—Cu—Fe—Mg—(Zn)-based aluminum alloy, and exhibits high strength and high yield strength in an as-cast state (i.e., without heat treatment).

However, since the ADC12 aluminum alloy exhibits low ductility, it is difficult to apply the ADC12 aluminum alloy to parts for which high toughness is required.

In particular, a reduction in weight is strongly desired in the fields of airplanes, rail vehicles, and automobiles, and a casting aluminum alloy that exhibits high ductility and can also be applied to structural members has been desired.

A hypo-eutectic Al—Si—Mg-based alloy and a hypo-eutectic Al—Mg—Si-based alloy have been studied as an aluminum alloy that exhibits high ductility (high toughness) and high strength.

Note that the term "Al—Si—Mg-based alloy" refers to an aluminum alloy in which the Si content (that is higher than the content of each component added to Al) is higher than the Mg content, and the term "Al—Mg—Si-based alloy" refers to an aluminum alloy in which the Mg content is higher than the Si content.

Typical examples of the Al—Si—Mg-based alloy include an AA365 alloy that is specified in the United States standards.

The AA365 alloy has a relatively high Si content (8 to 12 mass %) and a low Mg content (0.6 mass % or less). Since the AA365 alloy exhibits high ductility, but exhibits insufficient strength, it is necessary to perform heat treatment (e.g., T5 heat treatment) after the die casting process, whereby an increase in cost occurs. Moreover, a change in dimensions or shape may easily occur during the heat treatment.

An Al—Mg—Si-based alloy that has a high Mg content (2 to 8 mass %) and a low Si content (0.5 to 3 mass %) has been proposed.

However, this Al—Mg—Si-based alloy has a problem in that shrinkage may occur during solidification, and cracks (casting cracks) may easily occur during casting.

JP-A-2009-108409 discloses an Al—Mg-based aluminum alloy that includes 2.5 to 5.0 mass % of Mg, 0.3 to 1.5 mass % of Mn, and 0.1 to 0.3 mass % of Ti, and exhibits excellent toughness, the Al—Mg-based aluminum alloy preferably further including 0.2 to 0.6 mass % of Si and 0.005 to 0.05 mass % of Sr.

The Si content in the casting alloy disclosed in JP-A-2009-108409 is set to be as low as 0.2 to 0.6 mass % in order to suppress the needle-like growth (crystallization) of $Mg_2Si$ compounds (see paragraphs [0026] to [0028] of JP-A-2009-108409).

JP-T-2010-528187 discloses an aluminum alloy that is designed to reduce hot tearing sensitivity, and includes 0.01 to 0.025 mass % of Sr, and $TiB_2$ in an amount corresponding to 0.001 to 0.005 mass % of B.

In JP-T-2010-528187, Sr is added to promote the formation of spheroidal crystal grains in the α-Al crystal grains through a synergistic effect with $TiB_2$ (see paragraph of JP-T-2010-528187).

SUMMARY OF THE INVENTION

Technical Problem

An object of the invention is to provide a casting aluminum alloy that exhibits excellent casting crack resistance while exhibiting the characteristics of an Al—Mg—Si-based aluminum alloy that exhibits high ductility and high strength in an as-cast state, and a casting produced using the same.

Solution to Problems

A casting aluminum alloy according to the invention is an Al—Mg—Si-based aluminum alloy comprising 0.015 to 0.12 mass % of Sr, the casting aluminum alloy producing a cast metal structure in which $Mg_2Si$ is crystallized in a fine agglomerate form.

A known Al—Mg—Si-based aluminum alloy is designed to suppress the crystallization of $Mg_2Si$ compounds by setting the Si content to be significantly lower than the Mg content.

This is because a lamellar structure in which $Mg_2Si$ is stacked in a needle-like or layered form is formed, and the material properties significantly deteriorate as the Si content increases (although castability is improved).

The invention is characterized in that $Mg_2Si$ is crystallized in a fine agglomerate form during the solidification process through the addition of Sr.

The term "fine agglomerate form" used herein refers to a flaky form divided to have a size of 20 μm or less.

The aluminum alloy according to the invention is designed to allow the crystallization of $Mg_2Si$ instead of suppressing the crystallization of $Mg_2Si$. It is preferable that the Mg content in the aluminum alloy according to the invention be approximately equal to or higher to some extent than the stoichiometric composition of $Mg_2Si$ within the hypo-eutectic region taking account of the amount of Mg dissolved in the α-Al phase crystals.

For example, it is preferable that the Al—Mg—Si-based alloy include 2.0 to 7.5 mass % of Mg, 1.65 to 5.0 mass % of Si, and 0.015 to 0.12 mass % of Sr.

It is particularly preferable that the Mg content be 3.0 to 7.0 mass % and the Si content be 2.0 to 3.5 mass %.

The Mg content is set to 2.0 mass % or more since sufficient yield strength and ductility may not be obtained in an as-cast state if the Mg content is less than 2.0 mass %.

The Mg content is set to 7.5 mass % or less since the amount of $Mg_2Si$ to be crystallized may increase, and the mechanical properties of the resulting cast member may deteriorate if the Mg content exceeds 7.5 mass %.

The Si content is set to 1.65 mass % or more since deterioration in fluidity may occur during casting if the Si content is less than 1.65 mass %.

The Si content is set to 5.0 mass % or less since the Si content may be in excess with respect to the Mg content (see above) if the Si content exceeds 5.0 mass %.

The Sr content is set to 0.015 to 0.12 mass % taking account of the effect of refinement and agglomeration during the crystallization of $Mg_2Si$.

If the Sr content is less than 0.015 mass %, the $Mg_2Si$ refinement effect may be insufficient provided that the Mg content and the Si content are set within the above ranges.

If the Sr content exceeds 0.12 mass %, Al—Si—Sr-based crystallized products may be easily formed.

The Sr content is preferably 0.02 to 0.10 mass %, and more preferably 0.03 to 0.06 mass %.

The casting aluminum alloy according to the invention can be used to produce a casting using a gravity die casting process, a low pressure die casting process, or a high pressure casting process. The casting aluminum alloy according to the invention is particularly effective when producing a casting using a die casting process that injects aluminum alloy molten metal at a high speed under high pressure to effect rapid solidification.

The aluminum alloy according to the invention is characterized in that $Mg_2Si$ is crystallized in a fine agglomerate form during the solidification process. The aluminum alloy according to the invention may include a small amount of an additional component such as Mn, Fe, Cr, or Sn as long as the above effect is achieved.

Mn is dissolved in the matrix, and improves strength. Mn produces agglomerate-like Al—Mn intermetallic compounds, and prevents the penetration (fusion) of the molten metal into the die (mold). Mn is optionally added to the aluminum alloy in a ratio of 0.3 to 1.0 mass %.

It is preferable to add Mn to the aluminum alloy when the aluminum alloy is used for a die casting process.

Fe is normally mixed as impurities. When the Fe content is low, Fe produces Al—Fe-based intermetallic compounds, and prevents the penetration (fusion) of the molten metal into the die (mold). Note that it is preferable to limit the Fe content to 0.4 mass % or less.

Cr, Sn, and the like may be added to the aluminum alloy as long as the content thereof is limited to 0.5 mass % or less.

Cr has a solid-solution hardening effect, and Sn reduces the occurrence of shrinkage cavities.

It is known that Ti and B form $Ti_2B$ to refine the $\alpha$-phase crystal grains. Ti may be added in a ratio of 0.15 mass % or less, and B may be added in a ratio of 0.025 mass % or less.

About 10 to 50 ppm of Be may be added in order to prevent the oxidation and depletion of Mg.

Advantageous Effects of Invention

The casting aluminum alloy according to the invention is an Al—Mg—Si-based aluminum alloy, and exhibits improved casting crack resistance through the refinement and agglomeration of $Mg_2Si$ crystallized products due to the addition of Sr.

A casting produced using the aluminum alloy according to the invention exhibits excellent internal quality, and exhibits high ductility and high strength in an as-cast state.

BRIEF DESCRIPTION OF THE DRAWINGS

FIG. 1 illustrates the chemical composition of each alloy used for experimental evaluation, and the evaluation results for each alloy.

DESCRIPTION OF EMBODIMENTS

The castability of the Al—Mg—Si-based alloy according to the invention was evaluated by preparing each molten metal having the chemical composition listed in FIG. 1 (table), and casting each molten metal using an I-beam mold.

Figure 2:
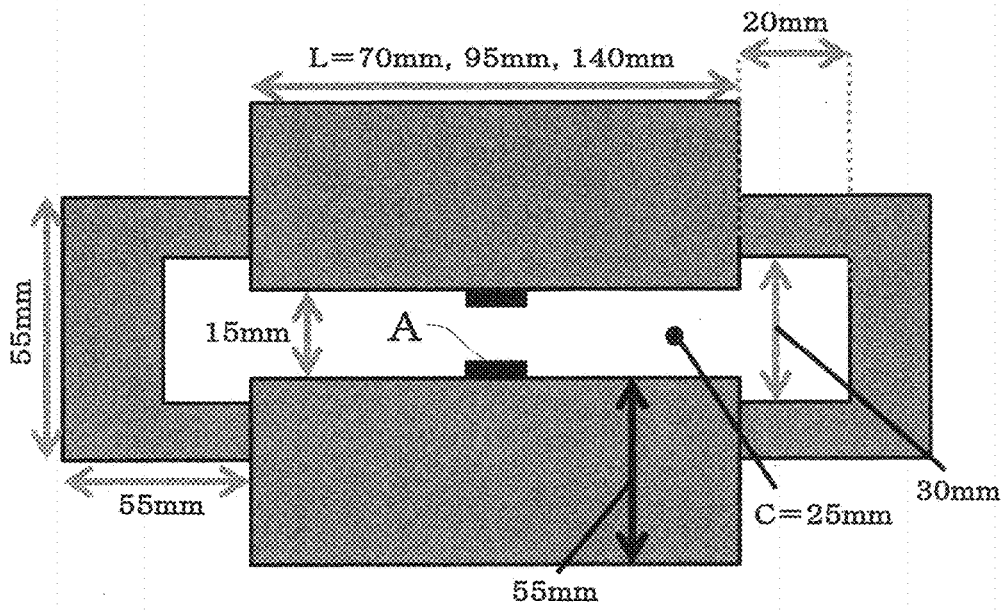
FIG. 2 is a schematic view illustrating an I-beam mold used when evaluating casting crack resistance.

FIG. 2 is a schematic view illustrating the I-beam mold used for casting.

In order to determine the difference in shrinkage stress due to the restraint length, three types of molds in which the depth C of the cavity was 25 mm, and the longitudinal length was 70, 95, or 140 mm, were used.

A thermal insulation material A was bonded to the center of the mold in the longitudinal direction so that shrinkage stress is concentrated on the final solidification part, and cracks occur at an identical position.

Bubbling with argon gas was performed for about 120 seconds in order to reduce the hydrogen content in the molten metal.

The mold temperature was set to 473±5 K when pouring the molten metal, and the molten metal was cast at a temperature higher than the melting point of each composition by 50±5 K.

Figure 3A:
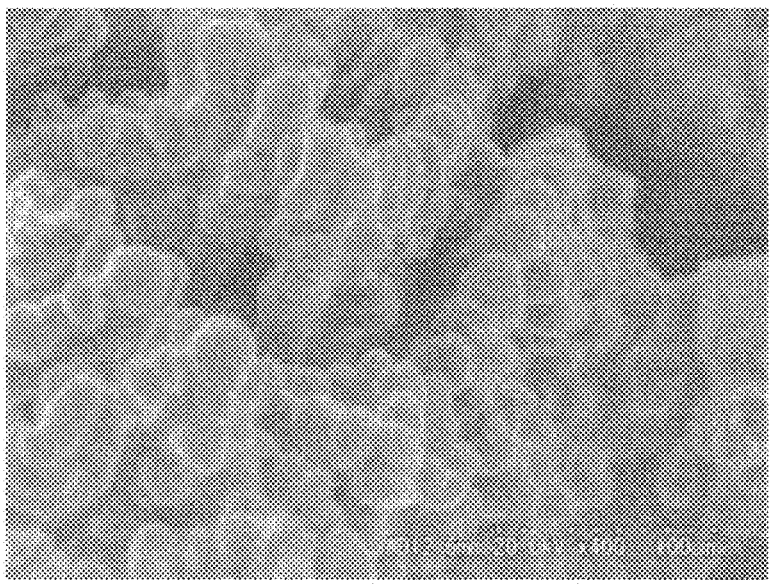
FIG. 3A illustrates a casting crack fracture surface.
Figure 3B:
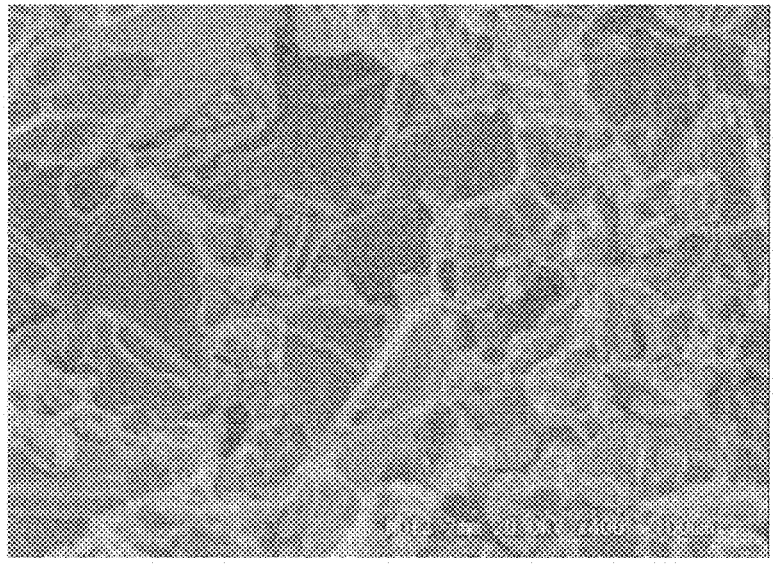
FIG. 3B illustrates a hot tearing fracture surface.

The fracture surface of the resulting I-beam casting (sample) in which cracks or complete fracture was observed in the final solidification part was observed using an SEM. A casting crack fracture surface having dendrite cells (see FIG. 3A), and a hot tearing fracture surface with a trace of plastic deformation (see FIG. 3B), were observed from the secondary electron image.

The casting crack fracture surface (see FIG. 3A) was divided into 15 areas. An 11-step value (0 to 10) was assigned to each area, a case where the casting crack ratio was 100% being assigned a value of 10, and the casting crack area ratio was calculated (i.e., the total value of the entire fracture surface was divided by the maximum value (=150)).

The results are listed in FIG. 1 (table).

The evaluation results for the alloys of Examples 1 to 7 (inventive alloys) and the alloys of Comparative Examples 11 to 15 are listed in FIG. 1.

In Examples 1 to 4 and Comparative Examples 14 and 15, the Sr content was changed with respect to the Al—6% Mg—3% Si composition.

As is clear from a comparison with the alloy of Comparative Example 15 to which Sr was not added, the casting crack resistance was improved due to the addition of Sr.

A significant effect was observed in Example 1 (Sr content=0.018 mass %) (i.e., more than 0.015 mass %), and the casting crack area ratio was 0% in Example 2 in which the Sr content was 0.03 mass %. The casting crack area ratio was 0% when the Sr content was 0.06 mass % or less (see Example 4).

In Example 5 in which the Sr content was 0.12 mass %, the casting crack resistance decreased to some extent.

Al—Si—Sr-based crystallized products (compounds) were observed when the fracture surface of the alloy of Example 5 was observed using an SEM.

In the castings of Examples 2 to 4, almost all (100%) of the $Mg_2Si$ crystallized phase had a fine agglomerate form.

In Example 6 in which 0.6 mass % of Mn was added in addition to 0.04 mass % of Sr, and Example 7 in which Ti and B were added in addition to 0.04 mass % of Sr, the effect of the addition of Sr was also observed.

In Comparative Examples 11 to 13 in which the Al—Mg—Si-based alloy composition was used, the effect of the addition of Ti and B was observed, but the casting crack area ratio did not reach 0%.

Figure 4:
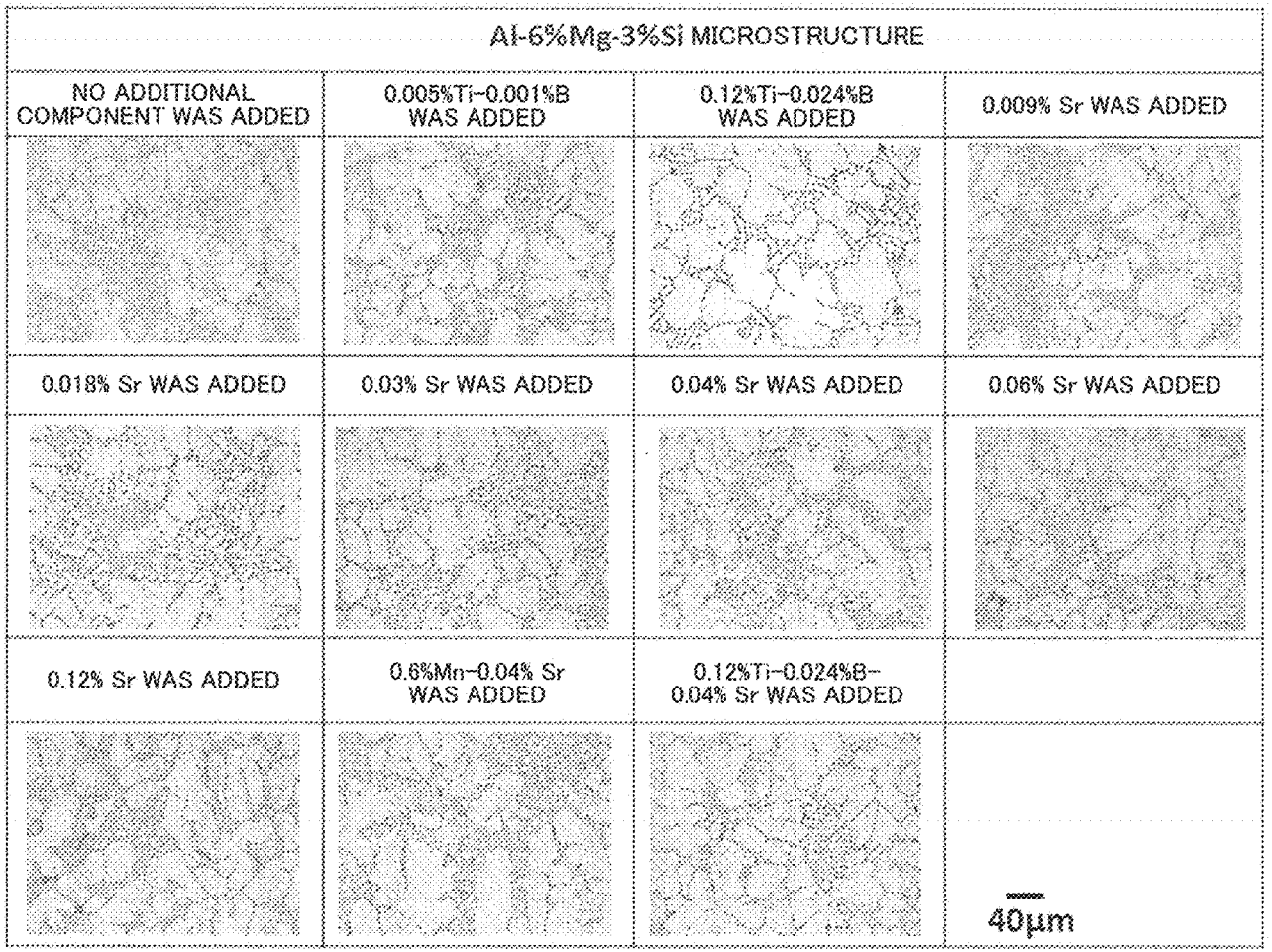
FIG. 4 illustrates a photograph of a microstructure when each component was added to an Al—6% Mg—3% Si composition.

A change in metal structure due to the addition of Sr was also determined. FIG. 4 illustrates a photograph of the microstructure of a casting obtained when each component was added to an Al—6% Mg—3% composition, and FIGS. 5A and 5B illustrate the SEM area analysis results (mapping analysis results) for each component.

Figure 5A:
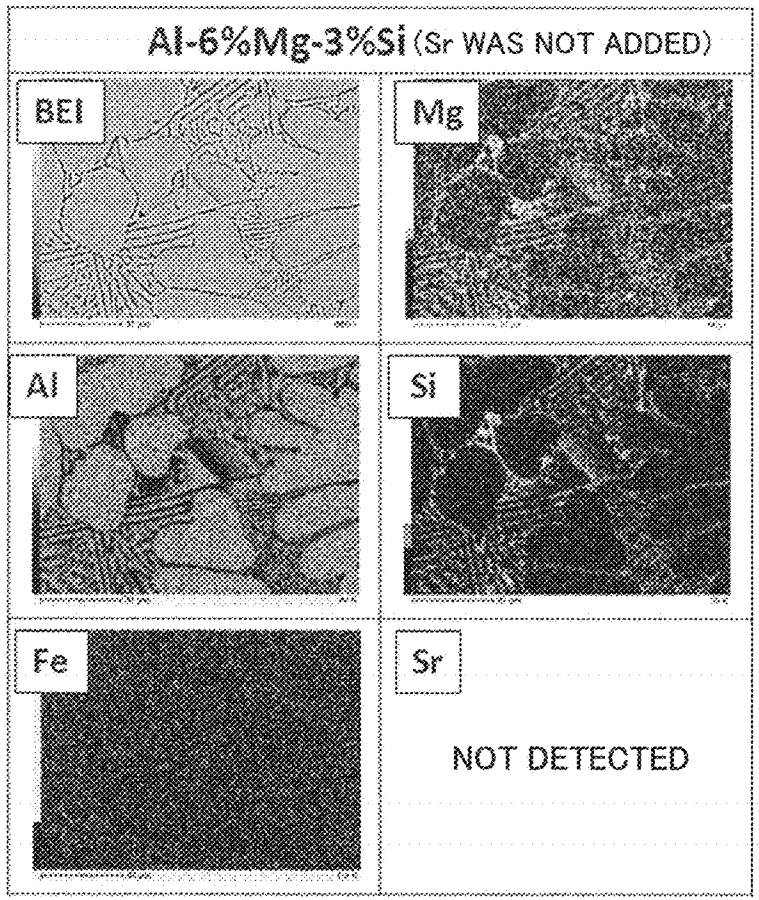
FIG. 5A illustrates an SEM area analysis photograph when Sr was added to an Al—6% Mg—3% Si composition.
Figure 5B:
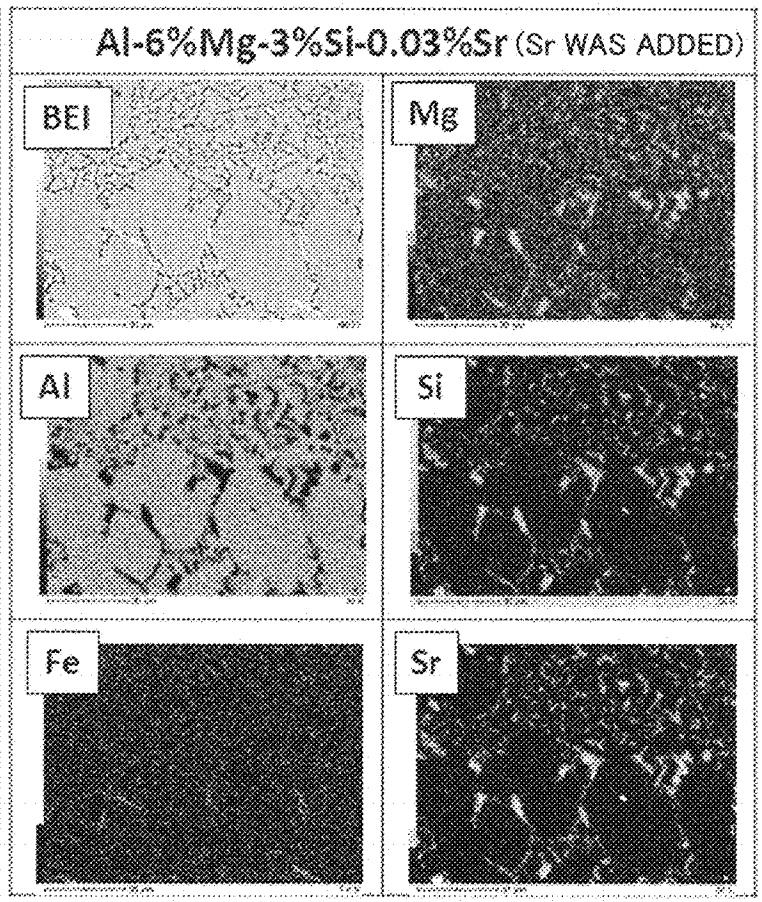
FIG. 5B illustrates an SEM area analysis photograph when Sr was not added to an Al—6% Mg—3% Si composition.

Note that "BEI" in FIGS. 5A and 5B indicates a back-scattered electron image.

As is clear from the photographs illustrated in FIG. 4, the needle-like (elongated) growth of $Mg_2Si$ (length: about 30 μm or more) was observed when Sr and/or Ti—B was not added.

The length of $Mg_2Si$ was reduced to some extent when Ti—B was added. However, the same refinement effect as that observed due to the addition of Sr was not observed.

As is clear from FIGS. 5A and 5B (mapping analysis results), it was found that the crystallized products were $Mg_2Si$.

In order to determine the shape of $Mg_2Si$, the Al—6% Mg—3% sample to which 0.03 mass % of Sr was added and the Al—6% Mg—3% sample to which Sr was not added (see FIG. 4) were corroded (only in the aluminum phase) using a sodium hydroxide aqueous solution to expose the $Mg_2Si$ eutectic phase.

Figure 6A:
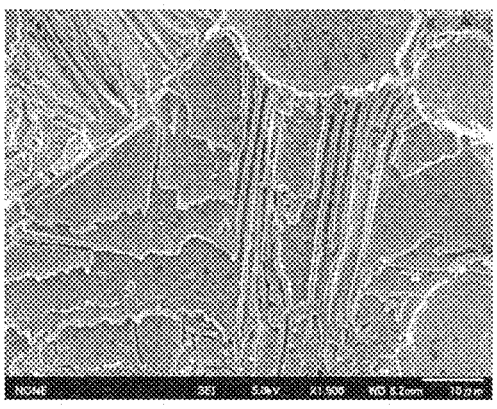
FIG. 6A illustrates an etching analysis photograph when Sr was added to an Al—6% Mg—3% Si composition.
Figure 6B:
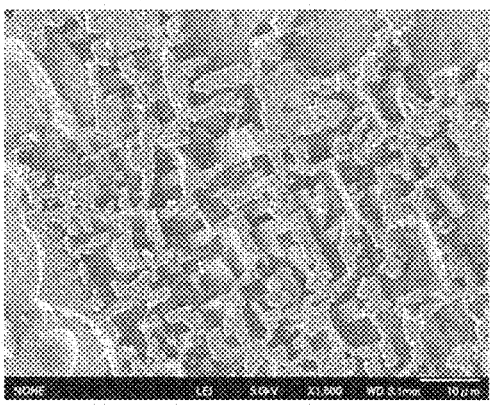
FIG. 6B illustrates an etching analysis photograph when Sr was not added to an Al—6% Mg—3% Si composition.

FIGS. 6A and 6B illustrate the SEM secondary electron image of each sample.

The sample illustrated in FIG. 6A (to which Sr was not added) had a lamellar crystallization form in which coarse plate-like layers having a thickness of 1 to 2 μm and a size of about 30 μm or more were stacked.

On the other hand, the sample illustrated in FIG. 6B (to which Sr was added in a ratio of 0.03 mass %) had a crystallization form in which $Mg_2Si$ was crystallized in a fine agglomerate form (thickness: 2 to 3 μm, size: 20 μm or less, average size: 10 μm or less).

The casting aluminum alloy according to the invention exhibits excellent casting crack resistance while maintaining the high ductility and the high strength of an Al—Mg—Si-based aluminum alloy. Therefore, the casting aluminum alloy according to the invention can be widely used to produce a casting (cast product) that is used in the fields of mechanical parts, airplanes, vehicles, and the like for which these properties are required.

What is claimed is:

1. An aluminum alloy that is an Al—Mg—Si-based aluminum alloy consisting of 2.0 to 7.5 mass % of Mg, 2.0 to 3.5 mass % of Si, and 0.015 to 0.12 mass % of Sr, with the balance being aluminum and unavoidable impurities.

2. A casting produced using the aluminum alloy as defined in claim 1, wherein $Mg_2Si$ is crystallized in a fine agglomerate form.

3. The aluminum alloy as defined in claim 1, comprising 3.0 to 7.0 mass % of Mg.

4. An aluminum alloy that is an Al—Mg—Si-based aluminum alloy consisting of 2.0 to 7.5 mass % of Mg, 2.0 to 3.5 mass % of Si, 0.0015 to 0.12 mass % of Sr, and 0.40 mass % or less of Fe, with the balance being aluminum and unavoidable impurities.

5. A casting produced using the aluminum alloy as defined in claim 4, wherein $Mg_2Si$ is crystallized in a fine agglomerate form.

6. The aluminum alloy as defined in claim 4, comprising 3.0 to 7.0 mass % of Mg.

7. An aluminum alloy that is an Al—Mg—Si-based aluminum alloy consisting of 2.0 to 7.5 mass % of Mg, 2.0 to 3.5 mass % of Si, 0.015 to 0.12 mass % of Sr, 0.3 to 1.0 mass % of Mn, and 0.40 mass % or less of Fe, with the balance being aluminum and unavoidable impurities.

8. A casting produced using the aluminum alloy as defined in claim 7, wherein $Mg_2Si$ is crystallized in a fine agglomerate form.

9. The aluminum alloy as defined in claim 7, comprising 3.0 to 7.0 mass % of Mg.

* * * * *